US009309856B2

(12) United States Patent
Drozdek

(10) Patent No.: US 9,309,856 B2
(45) Date of Patent: Apr. 12, 2016

(54) ASSEMBLY FOR A SPEED REDUCER OF A ROTARY ELECTRIC MACHINE, AND RELATED HEAT-ENGINE STARTER

(75) Inventor: Marius Drozdek, Villette D'Anthon (FR)

(73) Assignee: Valeo Equipements Electriques Moteur (FR)

( * ) Notice: Subject to any disclaimer, the term of this patent is extended or adjusted under 35 U.S.C. 154(b) by 372 days.

(21) Appl. No.: 13/994,621

(22) PCT Filed: Dec. 19, 2011

(86) PCT No.: PCT/FR2011/053048

§ 371 (c)(1),
(2), (4) Date: Aug. 30, 2013

(87) PCT Pub. No.: WO2012/085424

PCT Pub. Date: Jun. 28, 2012

(65) Prior Publication Data

US 2014/0007834 A1 Jan. 9, 2014

(30) Foreign Application Priority Data

Dec. 20, 2010 (FR) ..... 10 60785

(51) Int. Cl.

| | |
|---|---|
| ***F02N 15/00*** | (2006.01) |
| ***F02N 15/04*** | (2006.01) |
| ***F02N 15/06*** | (2006.01) |

(52) U.S. Cl.

CPC ..... *F02N 15/043* (2013.01); *F02N 15/046* (2013.01); *F02N 15/062* (2013.01); *F02N 15/065* (2013.01)

(58) Field of Classification Search

CPC .... F01N 15/043; F01N 15/046; F01N 15/062
USPC ..... 123/179.25, 179.1, 179.3; 74/6
See application file for complete search history.

(56) References Cited

U.S. PATENT DOCUMENTS

| | | | | |
|---|---|---|---|---|
| 2002/0069711 | A1 | 6/2002 | Hosoya | |
| 2007/0215089 | A1 * | 9/2007 | Grand | F02N 15/067 123/179.25 |

FOREIGN PATENT DOCUMENTS

| | | | | |
|---|---|---|---|---|
| DE | 28 22 165 | | 11/1979 | |
| DE | 3912432 | A1 * | 11/1989 | F02N 15/043 |
| EP | 0 749 194 | | 12/1996 | |
| EP | 1 094 246 | | 4/2001 | |
| EP | 2 048 356 | | 4/2009 | |
| EP | 2 067 984 | | 6/2009 | |
| FR | 2 611 096 | | 8/1988 | |
| FR | 2 631 094 | | 11/1989 | |

(Continued)

*Primary Examiner* — Mahmoud Gimie
(74) *Attorney, Agent, or Firm* — Berenato & White, LLC

(57) ABSTRACT

Assembly (57) for a speed reducer of a rotary electric machine, comprising: a ring gear (46) secured to a transverse wall (58); a base plate (60) to be securely and rotatably mounted relative to a mounting (16) of the machine; an axially acting resilient means, such as an axially acting resilient disc (64); and an added hub (68) on which the transverse wall (58) of the ring gear (46), the base plate (60), and the resilient means (64) are mounted. The hub (68) has at least one first shoulder (71) for supporting the axially acting resilient means (64), and at least one second shoulder (72) for supporting the transverse wall (58) of the ring gear (46). The assembly also relates to a starter, particularly for a motor vehicle.

21 Claims, 5 Drawing Sheets

(56) References Cited

FOREIGN PATENT DOCUMENTS

| | | |
|---|---|---|
| FR | 2 772 433 | 6/1999 |
| FR | 2 787 833 | 6/2000 |
| FR | 2 924 872 | 6/2009 |
| GB | 2 091 949 | 8/1982 |
| WO | WO 2005/054664 | 6/2005 |

* cited by examiner

ASSEMBLY FOR A SPEED REDUCER OF A ROTARY ELECTRIC MACHINE, AND RELATED HEAT-ENGINE STARTER

CROSS-REFERENCE TO RELATED APPLICATIONS AND CLAIM TO PRIORITY

This application is a national stage application of International Application No. PCT/FR2011/053048 filed Dec. 19, 2011, which claims priority to French Patent Application No. 10/60785 filed Dec. 20, 2010, of which the disclosures are incorporated herein by reference and to which priority is claimed.

TECHNICAL FIELD OF THE INVENTION

The invention relates to an assembly for a speed reducer of a rotary electrical machine, for example a starter of a thermal engine, in particular for a motor vehicle, and a starter for a thermal engine.

PRIOR ART

In order to start a thermal engine, which is also known as an internal combustion engine, in particular of a motor vehicle, it is known to use a rotary electrical machine in the form of a starter provided with a launcher which can transmit rotational energy of the starter to a crankshaft of the thermal engine by means of a drive ring.

This launcher is mounted on an output shaft of the electrical machine. According to one embodiment, a speed reducer is interposed between this output shaft, which constitutes the shaft of the launcher, and the shaft of the electric motor which the rotary electrical machine comprises. The interposition of the reducer has the advantage of using a faster electrical machine, and thus obtaining a greater starting torque, whilst reducing the dimensions and weight of the machine for a given power level. As described in document FR-2 631 094, this speed reducer can be formed by a toothed wheel in the form of a pinion which is secured at one end of the shaft of the electric motor of the electrical machine, and a toothed ring which is rendered integral in rotation by friction means of the shaft of the launcher, this ring having inner teeth which engage with the pinion. In this case, the shaft of the electric motor and the shaft of the launcher are offset relative to one another.

As a variant, as described in document WO2005/054664, the speed reducer is formed by an epicycloidal train comprising satellite opinions which are fitted such as to rotate around shafts which are supported by a satellite-holder comprising a transverse plate which is integral with the rear end of the shaft of the launcher. These satellite pinions engage with the pinion which is integral with the shaft of the electric motor, and with the inner teeth of the toothed ring which is immobile in rotation relative to the housing which the starter comprises. In this case, the shaft of the electric motor and the shaft of the launcher are coaxial.

In addition, the launcher comprises a pinion provided with teeth which are configured to engage with teeth of the drive ring, also known as the starter ring, which is integral in a rigid or resilient manner with the crankshaft of the thermal engine to be started. This launcher can be subjected to substantial mechanical impacts during the functioning of the starter, in particular during the launching of the thermal engine. For example, at the beginning of starting, when the rotation of the starter commences, the teeth of the pinion can slide against the teeth of the drive ring before engaging between the latter.

The axial overlapping of the respective teeth of the pinion and of the ring can then be very slight, and the kinetic energy of rotation of the starter is transmitted abruptly to the ring. At this instant, the contact stresses are very high, which, together with the wear, can give rise to the destruction of teeth of the ring. This phenomenon is known by the term milling.

In addition, during the starting of the thermal engine, if the injection system of the vehicle has random malfunctioning, premature explosions can occur in the combustion cycle which are generally known as "backfire", and can generate substantial impacts during the engagement of the pinion with the drive ring. Impacts can also occur during the stoppage of the thermal engine. These impacts create the risk of giving rise to breakage of teeth of the pinion or of the drive ring, resulting in a major incident. In general, the thermal engine can rotate in reverse in certain conditions, which means that the most fragile components need to be oversized.

In order to eliminate the above problems, application FR-2 631 094 describes a torque limiter designed for a speed reducer formed by the aforementioned ring and pinion assembly. The limiter comprises a hub with grooves for its connection in rotation to the output shaft of the starter which constitutes the shaft of the launcher. The toothed ring is fitted such as to be free in rotation via its flange on a support surface of the hub. The hub is provided with a body which is added by crimping onto the hub, or is integral with the latter. The body constitutes a friction disc for the limiter, which comprises resilient means with axial action in the form of a resilient washer with axial action, a friction lining and a support flange for the washer. The support flange is connected to the flange of the ring by means of braces through which screws pass.

This configuration is designed for a reducer without satellites. In addition, the resilient washer is supported at its inner periphery on the friction disc. An object of the invention is to create a torque limiter with a hub which can be used with a reducer with an epicycloidal train provided with resilient means with axial action which exert thrust on a larger diameter for better distribution of the forces on the friction disc.

In document EP 1 094 246, the speed reducer comprises a hub which is integral with a flange extended on its outer periphery by a cylindrical portion in which the toothed ring of the reducer is engaged. This solution requires a complicated part, and is cumbersome.

Reference can then be made to a system of the type described in document FR-2 924 872 which is considered to be the closest prior art. In this system, the speed reducer comprises a base plate which is connected in rotation with the housing of the starter, as well as a toothed ring which is supported against the base plate, and can rotate relative to the base plate when the toothed ring is subjected to a torque higher than a predetermined torque. For this purpose, the toothed ring comprises a transverse wall with orifices with a frusto-conical form, the base plate which is provided with bosses with a complementary form being subjected to the action of a resilient washer with axial action.

The object of the invention is to improve this system, in particular by simplifying the production of the ring.

SUBJECT OF THE INVENTION

For this purpose, the invention implements an assembly for a speed reducer of a rotary electrical machine comprising:

a ring which is integral with a transverse wall;

a base plate which is designed to be mounted integrally in rotation relative to a housing of the machine;

resilient means with axial action, such as a resilient washer with axial action; and an added-on hub with an axis of symmetry on which these elements are mounted, the base plate being positioned between the resilient means with axial action and the transverse wall of the ring;

this hub supporting at least one first shoulder for support of the resilient means with axial action; and at least one second shoulder for support of the transverse wall of the ring.

This therefore creates a force loop according to which the resilient means with axial action, such as a resilient washer, which are supported on the first shoulder, exert an axial compression force in the direction of the transverse wall of the ring, whereas the second shoulder retains the wall of the ring in translation, such that the base plate is sandwiched between the washer and the transverse wall. The ring is thus immobile in rotation relative to the base plate, when normal forces are applied on the ring. On the other hand, when the forces become greater than normal, the transverse wall can rotate around the axis of the hub whilst rubbing against the base plate, if necessary by means of at least one lining, in order to limit the torque applied to the starter and protect the constituents of the electrical machine.

The solution according to the invention takes advantage of the hub, which carries out several functions, and makes it possible to simplify the speed reducer which uses simple parts, in particular a toothed ring which is integral with a transverse wall, contrary to that described in document EP 1 094 246. The solution according to the invention is more compact, in particular axially.

According to one embodiment, the resilient means with axial action are supported indirectly on the first shoulder by means of a closure washer which is supported on the first shoulder, and is positioned in a groove provided around the hub.

According to one embodiment, the assembly comprises mounting means of the bayonet type, which can ensure co-operation between the first shoulder and the closure washer.

According to one embodiment, the first shoulder is constituted by turning down material of the hub.

According to one embodiment, with the ring being made of a plastic material, this ring is over-moulded on the outer periphery of the transverse wall.

According to one embodiment, with the transverse wall comprising through openings, the ring comprises pins which pass through these openings, these pins opening onto an outer surface of the transverse wall, opposite an inner surface from which the teeth of the ring extend.

According to one embodiment, the base plate is supported directly on the pins of the ring.

According to one embodiment, the assembly comprises a friction lining which is interposed between the transverse wall of the ring and the base plate.

According to one embodiment, the assembly additionally comprises a friction lining which is positioned between the base plate and the resilient washer with axial action.

According to one embodiment, the friction lining(s) is/are connected in rotation with the hub.

According to one embodiment, the hub has at least one flattened part, and the friction lining(s) has/have an opening with at least one flattened part with a complementary form, for connection in rotation with the hub by co-operation of forms.

According to one embodiment, the hub comprises a section with four flattened parts which are parallel in pairs, connected to one another by means of cylindrical parts, the friction lining(s) having an opening with a complementary form.

According to one embodiment, the lining(s) is/are glued on lateral surfaces of the base plate.

According to one embodiment, the second shoulder is divided up into several parts belonging to the hub, and each having support surfaces.

According to one embodiment, the support surfaces of the parts are offset angularly relative to the flattened parts.

According to one embodiment, the cylindrical parts are each connected to a part belonging to the hub.

According to one embodiment, the transverse wall has a central opening, and is hollowed at the level of the central opening for formation of four rims for receipt of the parts.

According to one embodiment, the assembly comprises a washer for dissipation of the forces associated with the resilient means with axial action.

According to one embodiment, the resilient means with axial action consist of a resilient washer with axial action comprising a washer of the Belleville type.

The invention also relates to a starter for a motor vehicle characterised in that it comprises:

an electrical machine comprising an output shaft;

an epicycloidal train comprising a planet wheel which is connected in rotation with the output shaft of the electrical machine;

an assembly according to the invention: and a satellite-holder which engages firstly with the planet wheel, and secondly with the ring of the assembly according to the invention, this satellite-holder being connected in rotation with an output shaft of the starter which supports a drive pinion designed to be engaged with the teeth of the drive ring of a thermal engine of the vehicle.

According to one embodiment, the hub has in its centre a transverse opening which permits the passage of the output shaft of the starter, the pinion belongs to a launcher comprising a drive unit, the transverse opening comprises two cylindrical parts which are separated by an inner annular part with a smaller inner diameter than the two other cylindrical parts, and the inner annular part constitutes a stop which is designed to co-operate with the rear surface of the drive unit.

Other advantages will become apparent from reading the following description and examining the figures which accompany it. These figures are provided purely by way of illustration but in no way limit the invention.

DESCRIPTION OF A PREFERRED EMBODIMENT OF THE INVENTION

In the description, elements which are identical, similar or analogous retain the same reference from one figure to another, and hereinafter in the description use will be made of axial orientation going from the rear forwards, corresponding to the orientation from left to right according to FIGS. 2 and 4.

Figure 1:
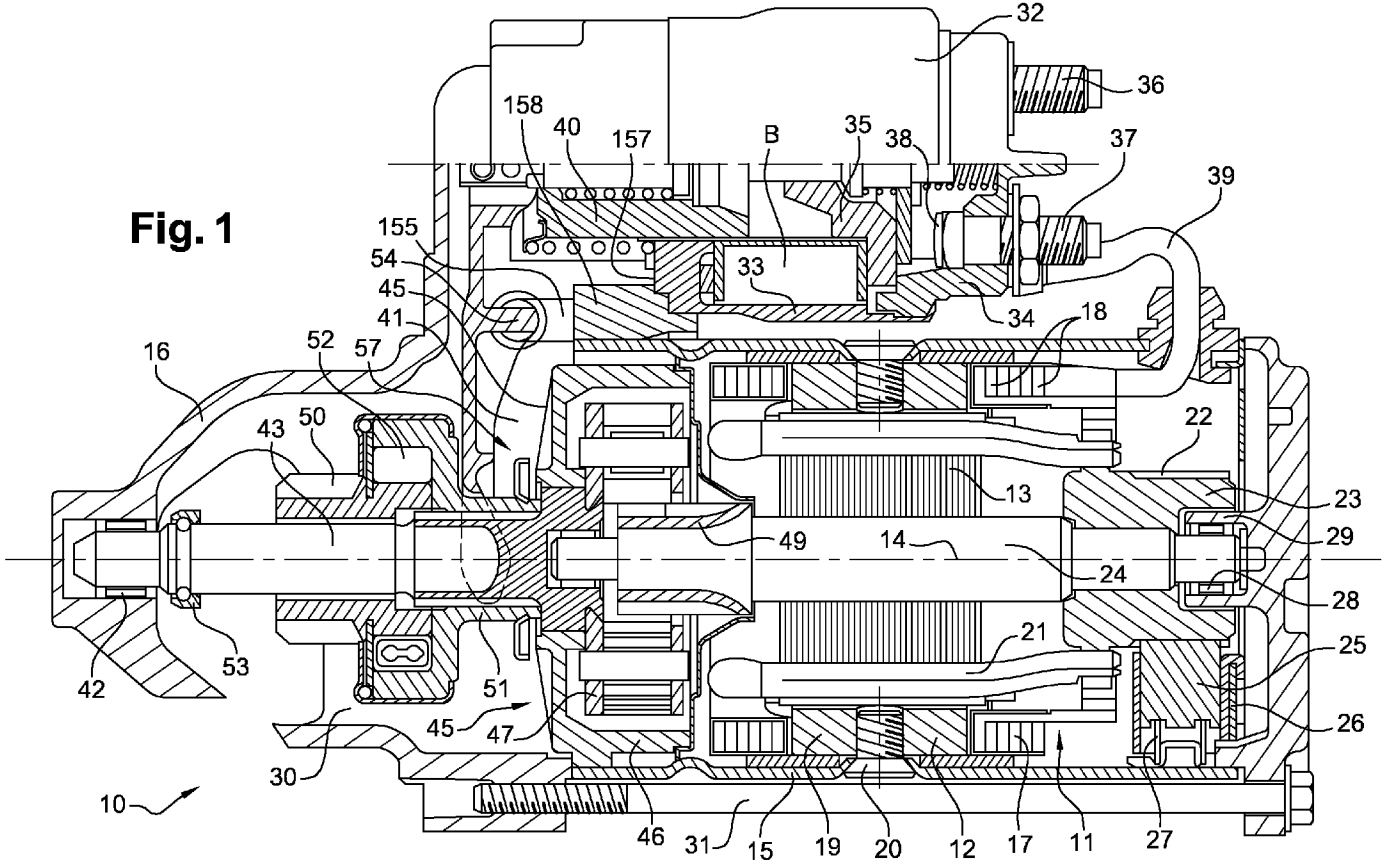
FIG. 1 is a view in axial cross-section of an electromagnetic starter according to the invention.

With reference to FIG. 1, the rotary electrical machine is a starter 10 of a thermal engine similar to the starter described in document WO 2005/054664, such that elements which are identical or similar to those in FIG. 1 of this document WO 2005/054664, to which reference will be made for greater detail, will be allocated the same reference signs. This FIG. 1 shows only part of the rear end of the output shaft 43, and a part of the speed reducer 45 which can be seen in FIGS. 2 and 3. According to the invention, this speed reducer 45 belongs to a speed reducer 57 described below. In this embodiment, the starter comprises an output shaft 43, a launcher 30 which is mounted on the shaft 43 and an electric motor 11 consisting of an inducing stator 12 and an induced rotor 13 which are mounted coaxially, with the stator 12 surrounding the rotor 13, which is mounted such as to rotate around an axis 14 inside a cylinder head 15. The latter is integral with the metal support 16 of the starter which is designed to be secured on a fixed part of the motor vehicle. In this case, the support 16 is made of material which can be moulded, for example it is based on aluminium, and belongs to the housing of the machine.

In a known manner, in one embodiment, the stator 12 comprises a plurality of permanent inducing magnets which are supported by the inner periphery of the cylinder head 15. As a variant, as shown in the embodiment in FIG. 1, the stator 12 comprises an inducing winding 17 comprising two pairs of coils 18, which are each wound around a polar mass 19 which is integral with the cylinder head 15. The polar masses 19 are secured by means of screws 20 to the cylinder head 15, which in this case is made of metal, as described in document FR-A-2 611 096. Each coil 18 consists of a continuous conductor which is wound around the polar mass 19 in the direction of its thickness, such as to form concentric contiguous turns with a diameter which increases as can be seen better in FIGS. 2 to 5 of document EP A 749 194. The axis of each coil 18 is radial relative to the axis 14 of the rotor 13, which constitutes the axis of rotation of the electric motor 11.

The rotor 13 comprises a set of plates provided with grooves for the mounting of electrical conductors 21 in the form of pins. These conductors 21 are connected to one another in order to form a rotor winding in association with conductive metal sheets 22 belonging to a collector 23 with an electrically insulating body which is integral with the shaft 24 of the electric motor 11. As a variant, the winding has a continuous wire.

Brushes 25 rub on the collecting metal sheets 22 of the collector 23 in order to supply the rotor winding. The brushes 25 belong to a brush-holder 26 equipped with cages for guiding and receipt of the brushes, which are thrust in the direction of the collecting metal sheets 22 by springs 27. The brush-holder 26 is integral with a rear metal bearing 28 which in the central part has a receptacle for mounting of a needle bearing 29. The bearing 28 is used for the mounting in rotation of the rear end of the shaft 24 of the electric motor 11. The axis of this shaft 24 is combined with the axis 14 of the rotor 13, and with the axis of the output shaft 43 of the starter, constituting the shaft of the launcher 30. The rear bearing 28 acts as a centring device at the rear end of the cylinder head 15, and is connected by tie rods 31 to the support 16 of the starter 10. Two threaded holes (with no reference) are provided in the support for screwing of the tie rods. The tie rods 31 are implanted on the exterior of the cylinder head 15. In this case, slight play exists between the tie rods and the outer periphery of the cylinder head 15 with a tubular form. The metal cylinder head 15 is interposed by being clamped between the metal support 16 and the rear metal bearing 28. The housing of the starter thus comprises the bearing 28, the cylinder head 15 and the support 16. This housing is designed to be connected to the earth of the motor vehicle via its support 16.

The starter 10 also comprises an electromagnetic contactor 32 which extends parallel to the electric motor 11, whilst being implanted radially above the latter. The contactor 32 has a metal vessel 33 which is supported by the support 16, and is equipped with an excitation winding B provided with at least one coil. The vessel 33 is closed at the rear by a cover 34 made of electrically insulating material. The cover 34 is secured by turning down material of the free end of the vessel 33. A shoulder of the vessel 33 makes it possible to ensure the axial wedging of a fixed hub 35, which is wedged axially in the other direction by the cover 34 which supports electrical supply terminals 36, 37.

The terminals 36, 37 are designed such as each to form a fixed contact 38 inside the cover 34. One of the terminals 36 is designed to be connected to the positive terminal of the battery, and the other terminal 37 is connected by means of a cable 39 to the input of the inducing winding 17 of the stator and to the brushes 25 with positive polarity. In a known manner, during the excitation of the winding B, a mobile core 40 is drawn by magnetic attraction in the direction of the fixed core 35, in order firstly to act after elimination of play on a rod (with no reference) which bears a mobile contact (with no reference), so as to give rise to the closure of the contacts of the contactor 32 and to supply the electric motor of the starter, and, secondly, to activate a lever 41 to control the launcher 30.

The output shaft 43 is fitted such as to rotate in a front bearing 42 of the support 16. This bearing 42 is constituted for example by a needle bearing, or as a variant by a smooth bearing. This shaft 43 bears at the front a stop 53 adjacent to the bearing 42, in order to limit the displacement of the launcher 30. As can be seen in FIGS. 2 and 3, the rear end 43.2 of the shaft 43 is configured such as to be integral with a plate of a satellite-holder 47, for example by crimping, this satellite-holder 47 belonging to an epicycloidal train which constitutes the speed reducer 45 with gears. This satellite-holder 47 bears satellites 47.1 which engage firstly with a ring 46 (described in greater detail below) and with a sun gear 49 which is integral with the front end of the shaft 24 of the electric motor. The reducer 45 is of the type described in document FR 2 787 833, to which reference will be made, with the latter showing the mounting of the front end of the shaft 24 of the electric motor 11 in the rear end 43.2 of the shaft 43, provided with a blind a hole in which there is accommodated the front end of the shaft 24, with interposition of a smooth bearing and a ball. This conventional mounting can also be seen in FIG. 9. The satellites 47.1 are thus mounted such as each to rotate around an axis. These axes extend between two plates with orientation which is transverse relative to the axis of the shaft 43, whilst being supported by these plates, one of which is thicker than the other, and in this case is secured by being crimped on the rear end 43.2 of the shaft 43. As a variant, the satellite-holder 47 comprises a single plate which is secured on the rear end of the shaft 43, and bears the axes.

The launcher 30 is mounted such as to slide on the output shaft 43, and comprises a drive pinion 50, a drive unit 51 which is configured to be activated by the pivoting control lever 41, and a free wheel 52 with rollers, which is interposed axially between the drive unit 51 and the pinion 50. In a known manner, the teeth of the pinion 50 belong to a sleeve which is extended at the rear in order to form the cylindrical outer track of the free wheel 52 with rollers. The drive unit 51 is extended axially at the front by a bush which is configured on the interior so as to form the profiled outer track of the free wheel 52 with rollers, and to accommodate the springs which act in a known manner on the rollers. More specifically, the drive unit 51 comprises a sleeve which is integral at the front with a flange with orientation which is transverse relative to the axis of the shaft 43. This flange is integral on its outer periphery with the bush with orientation which is axial relative to the axis of the shaft 43, in order to form a cage for receipt of rollers which is closed at the front by washers. The drive unit 51 bears a washer (with no reference), thus defining with the flange of the drive unit 51 a groove for receipt of the fingers of the inner end of the lever 41 in the form of a fork, as can be seen better in FIG. 3. The upper end of the lever 41 is mounted in a known manner such as to be articulated on a rod (with no reference in FIG. 1) which is connected resiliently to the mobile core 40 via a spring which is accommodated in the mobile core 40. It will be appreciated that, as a variant, the lever 41 is mounted such as to be articulated on the mobile core 40, and the spring surrounds the sleeve of the drive unit, whilst being supported on the flange of the drive unit, as described for example in document DE 28 22 165.

Figure 2:
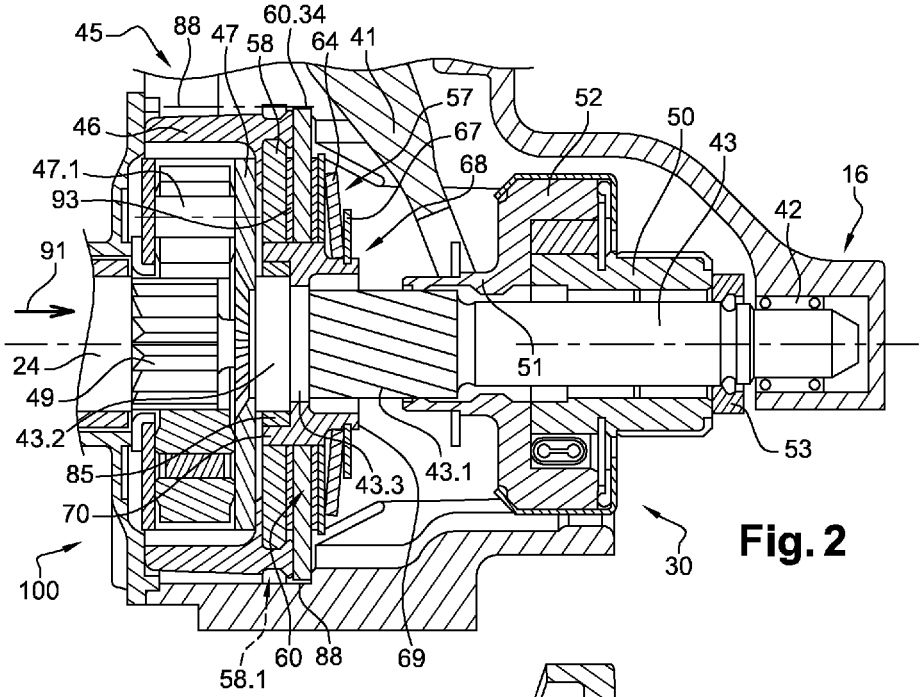
FIG. 2 is a detailed view in axial cross section of the speed reducer of the starter in FIG. 1, provided with an assembly according to the invention.
Figure 3:
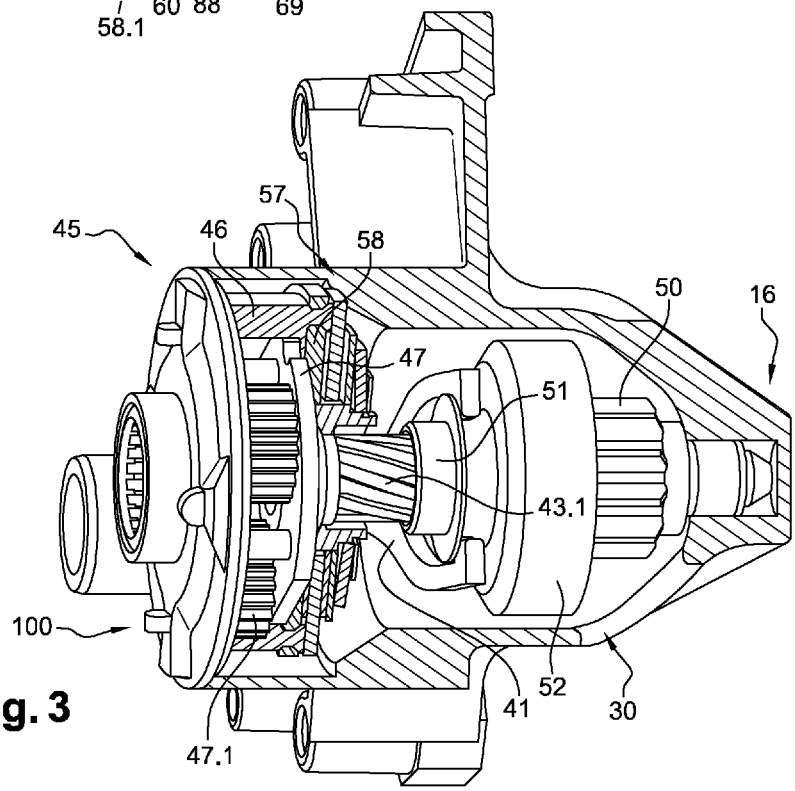
FIG. 3 is the detailed view of FIG. 2 in three dimensions.

In a known manner, the sleeve of the drive unit 51 is provided in its interior with a helical channels (with no reference) which are engaged in a complementary manner with outer helical toothing with the reference 43.1 in FIG. 2, supported by the output shaft 43 in the vicinity of its rear end 43.2, which in this case is cylindrical and has a larger diameter. The launcher 30 is thus provided with helical movement when it is displaced by the lever 41 in the direction of the stop 53, in order to reach the position in FIGS. 2 and 3 through the intermediary of its pinion 50, engaged with the drive ring, known as the starting ring (not shown) of a thermal engine, which is also known as an internal combustion engine.

It is clear that the device 52 with a free wheel can be replaced by a connection device with conical engagement, of the type described in document FR-A 2 772 433, or a clutch with several discs. It is also clear that, as a variant, the launcher 30 is implanted partly on the exterior of the support 16, at the front of the latter. More specifically, instead of being implanted in the support (FIGS. 1 to 3), the pinion 50 of the launcher 30 can be implanted on the exterior of the support, as can be seen for example in document FR A 2 745 855, to which reference will be made.

The control lever 41 is coupled in this case resiliently, or as a variant rigidly, in the aforementioned manner, by its upper end, with the mobile core 40 of the contactor 32, and comprises in its median part a pivoting shaft 54, which, according to one characteristic, is distinct from the toothed ring 46 of the speed reducer 45 with the gears, on the basis of the structure of the assembly 57 described below. The lever 41 is a moulded part, preferably made of rigid thermoplastic material in order to reduce noise, which is preferably reinforced by fibres. The mounting of the pivoting shaft 54 is carried out for example by means of a support part, such as in documents DE 28 22 165 and FR 2 787 833, or in the support 16 provided with projections for this purpose, the shaft 54 being distinct from, or integrated with the lever 41. In the embodiment in FIG. 1, as in document DE 28 22 165, an elastomer sealing pin 158 is provided in order to absorb the dimensional variations. This pin 158 is in contact with the support surface 157 of the contactor, and is integral with a part made of plastic material 155 which is configured to replace the tongue(s) 55 in FIG. 1 of document WO 2005/054664, with the receptacle of the support 16 being retained. As a variant, the pin 158 is eliminated, and it is the part made of plastic material 155 which is then in contact with the surface 157. It is also possible to make use of the solution described in document WO 01/31195. This all depends on the applications.

As shown in FIGS. 2, 3, 4, 5, 7, 8 and 9, the ring 46 of the speed reducer 45 has a hollow form, and forms part of an assembly 57 comprising a transverse wall 58 which is integral with the ring 46, a base plate 60 connected in rotation with the support 16 of the starter, friction linings 61, 62 which are positioned on both sides of the plate 60, resilient means with axial action, which are in the form, in FIGS. 2 to 9, of a resilient washer 64 with axial action, used in combination with a disc 65 for dissipation of forces, and a closure washer 67.

According to one characteristic, the elements 58, 60, 61, 62, 64, 65 and 67 are mounted on an added-on hub 68, thus assuring their centring. This hub 68 supports at least one first shoulder 71 for support in a direct or indirect manner of the resilient washer 64, and at least one second shoulder 72, in FIGS. 2 to 8, for support of the transverse wall 58 of the ring 46. The shaft 43 of the launcher 30 is mounted such as to rotate in the interior of the hub 68 by means of a bearing 85 which intervenes between the outer periphery of the cylindrical rear end 43.2 of the shaft 43, and the inner periphery of the hub 68. This hub 68 is a support hub with a stepped diameter, as can be seen better in FIGS. 4 and 6, which, according to one characteristic, is centred relative to the rear end 43.2 of the shaft 43 via the bearing 85, which in this case is a smooth bearing, such as a bushing. The elements 58, 60, 61, 62, 64, 65 and 67 are perforated centrally. According to one characteristic, the hub 68 for centring of the elements 58, 60, 61, 62, 64, 65 and 67 is associated with the wall 58, which makes it possible to retain the structure of the ring 46. The base plate 60 is simplified relative to those of document FR 2 924 872. The forces on the wall 58 are well distributed, which makes it possible to conserve the ring 46. The resilient washer 64 with axial action in FIGS. 2 to 5 acts at the level of its outer periphery on a large diameter, such that the forces are well distributed on the linings 61, 62, the base plate 60 and the wall 58.

Figure 5:
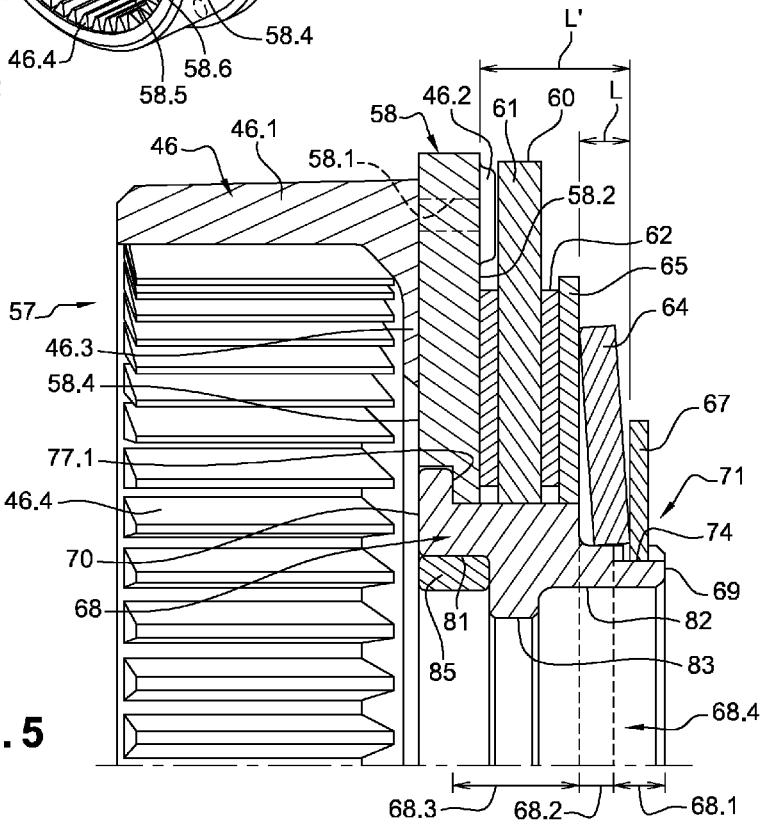
FIG. 5 is a view in partial axial cross-section of the reducer assembly according to the invention in an assembled state.
Figure 6:
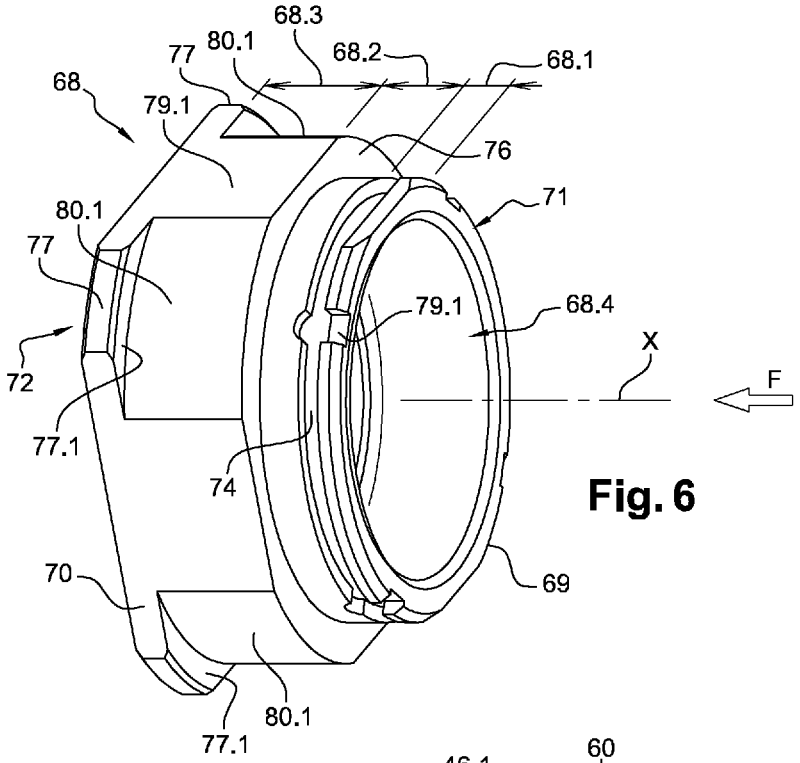
FIG. 6 is a view in three-dimensions of the hub of the assembly according to the invention.
Figure 7:
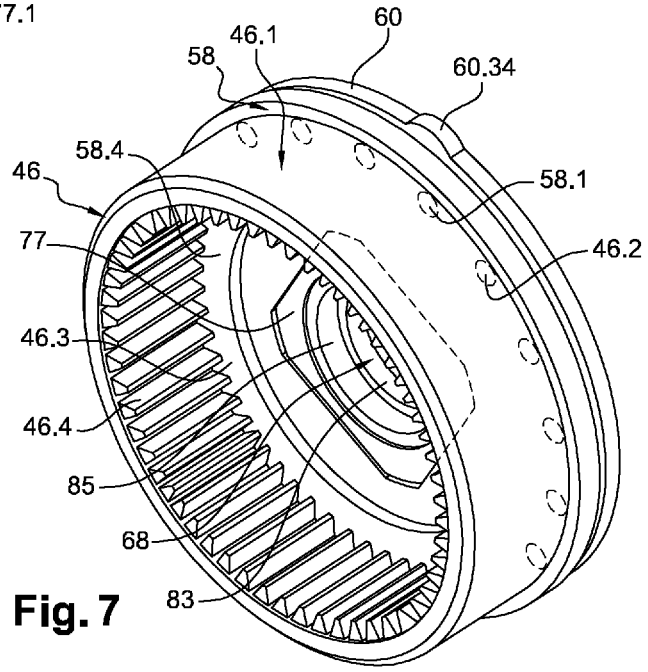
FIGS. 7 and 8 are views in three-dimensions of the front and back of the reducer assembly according to the invention in an assembled state.
Figure 8:
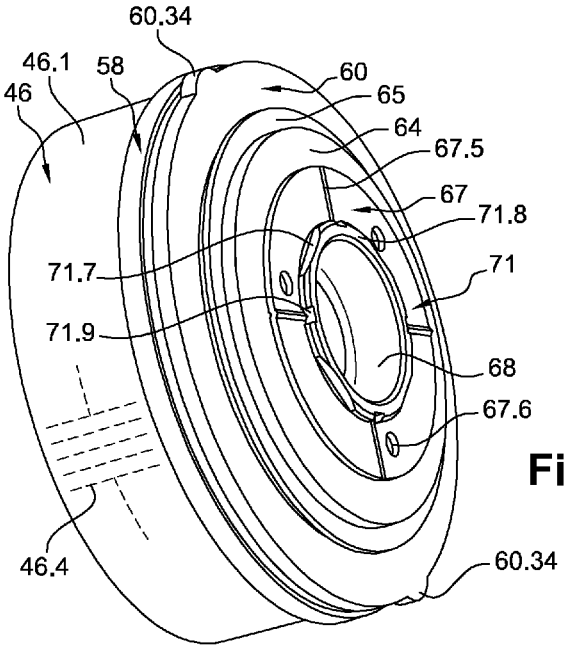

More specifically, as can be seen in FIG. 6, the hub 68 has an axis of symmetry X with axial orientation, which is combined with the axis of axial symmetry of the shaft 43. The elements 58, 60, 61, 62, 64, 65 and 67 have orientation which is transverse relative to this axis X, the resilient washer 64 being inclined axially. On its front axial end side 69 which is closest to the drive unit 51, this support hub 68 has a first axial section 68.1 in which there is provided an annular groove 74. This groove 74 is designed to receive the inner periphery of the closure washer 67, and is delimited at the front by a rim 71 which is transverse relative to the axis of the shaft 43 adjacent to the front end 69 of the hub 68. This rim 71 forms the first shoulder 71, and is configured in the manner described below, such as to permit mounting of the bayonet type of the closure washer 67 in the groove 74. The hub 68 comprises a second cylindrical axial section 68.2 which extends in the extension of the first section 68.1, as far as the projecting front end 76 of a third axial section 68.3, which delimits the rear end of the second section 68.2, and forms a shoulder. This second section 68.2 is designed to receive the resilient washer 64. The front end of this section 68.2 forms the rear flank of the groove 74, the front flank of which is constituted by the rear end surface of the shoulder 71. In this embodiment, the resilient washer 64 is supported indirectly on this shoulder 71 via the closure washer 67 which abuts the shoulder 71. The length L (FIG. 5) which extends between the front end 76 of the third section 68.3 and the rear surface 67.1 of the closure washer 67 against which the washer 64 is supported, constitutes the working length of the resilient washer 64, which in this case is a Belleville washer. This length L is shorter than the length L' which exists between the rear surface of the washer 67 and the front surface of the wall 58. The third axial section 68.3 prolongs the second section 68.2 as far as the rear axial end 70 of the hub 68, which, in the embodiment in FIGS. 2 to 8, constitutes the rear end surface of a projecting shoulder 72 which constitutes the second shoulder. This third shoulder 68.3 extends between the projecting end 76 of the second section 68.2 which forms a shoulder, and the second projecting shoulder 72. The hub 68 is thus stepped axially, with its third section 68.3 projecting radially relative to the second section 68.2 which delimits the groove 74 of the first section 68.1.

According to one characteristic, the third section 68.3 comprises at least one flattened part, whereas, according to one embodiment, the wall 58, the disc 65 and the washers 61, 62 have a central opening respectively 58.3, 65.3, 61.3, provided with at least one complementary flattened part, in order to co-operate by co-operation of forms with the flattened part of the section 68.3, for blocking in rotation of these parts 58, 65, 61, 62, with the possibility of axial movement, depending in particular on the wear of the linings 61, 62. According to one embodiment, the shoulder 72 is continuous, and the rear surface 58.2 of the wall 58 is in contact with the front surface of this shoulder 72 with an annular form. In the embodiment in FIGS. 2 to 8, the shoulder 72 is divided up into four projecting parts 77 which are distributed regularly circumferentially, in order to reduce the axial dimension of the assembly 57 as described below. The front surfaces 77.1 of each of these parts 77 form a support surface against which there comes into contact a rim 58.5 with a form similar to the transverse wall 58 provided at the level of the central opening 58.3 in the wall 58. The wall 58 thus has four rims 58.5 which, according to one embodiment, constitute the base of hollows 58.6 formed by removal of material, or as a variant, by embossing of material of the rear end side 70 of the hub 68. The hub 68 thus has a support function.

Figure 4:
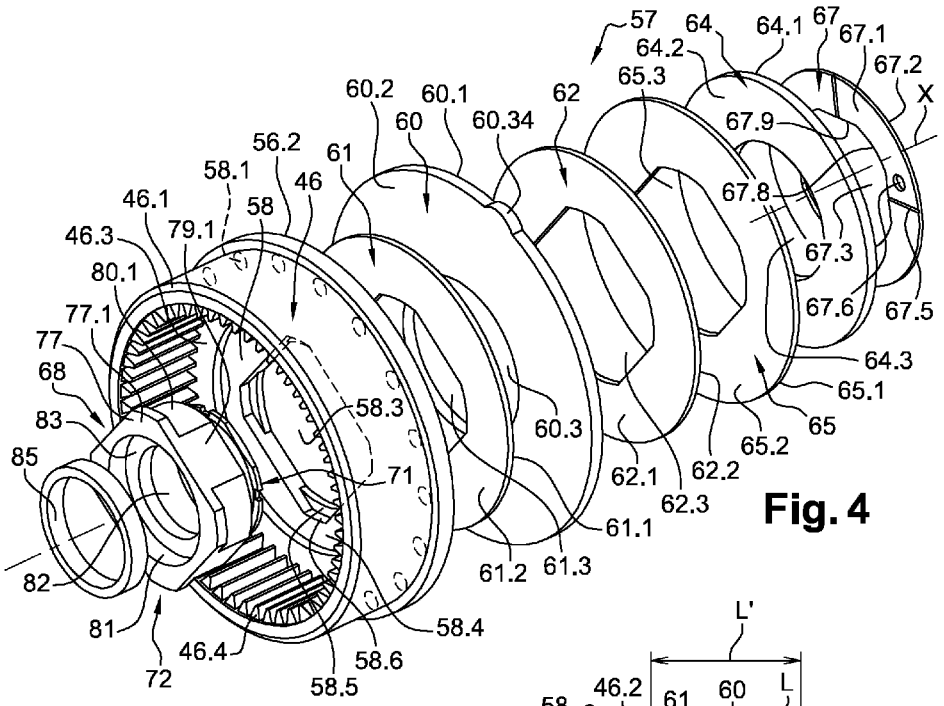
FIG. 4 is an exploded view of the reducer assembly according to the invention.

The third section 68.3 receives the wall 58, the washers 61, 62 and the disc 65, which are designed to be connected in rotation with the hub 68 via this third section 68.3 having in the embodiment in FIGS. 2 to 9 four flattened parts 79.1 which are parallel in pairs, i.e. diametrically opposite, connected to one another by means of cylindrical parts 80.1, with a diameter larger than that of the second section 68.2, whereas (see FIG. 4) the transverse wall 58, the linings 61, 62 and the disc 65 for dispersion have an inner opening 58.3, 61.3, 62.3, 65.3 with a complementary form for their blocking in rotation relative to the hub 68. The cylindrical parts are connected at the rear to the parts 77. The flattened parts 79.1 each have a surface parallel to the axis X. Preferably, the parts 77, and thus the support surfaces 77.1 are offset angularly relative to the flattened parts 79.1 on the circumference of the hub 68. The hub 68 thus has a function of blocking in rotation of the washers 61, 62, of the wall 58, and of the disc 65. This hub 68 receives in rotation, firstly the resilient washer 64, interposed between the washer 67 and the disc 65 which are wedged in rotation on the hub 68, and secondly the base plate 60, in the manner described below. It will be noted that the solution with four flattened parts 79.1, four cylindrical parts 80.1, and four support surfaces 77.1, makes it possible to obtain more efficient and reliable blocking in rotation than with a single flattened part, whilst having a good support for the wall 58, and a reduced dimension at the level of the shoulder 72 divided into four parts 77. In fact, as can be seen in FIG. 4, the shoulder 72 has a substantially square form with rounded angles, because of the presence of the flattened parts 79.1 and the parts 77, each with a circular outer periphery and lateral edges, which constitute a transverse extension of the flattened parts 79.1. The outer diameter of the parts 77 is larger than that of the parts 80.1. By means of this solution, greater transmission of torque is obtained, firstly between the hub 68, and secondly the wall 58, the linings 61, 61 and the disc 65.

In addition, the hub 68 has in its centre a through opening 68.4 which permits the passage of the shaft 43 of the launcher. This opening 68.4 comprises two coaxial cylindrical parts 81, 82 with a different diameter, which are separated from one another by an inner annular part 83 (see FIGS. 4 and 5), with a smaller inner diameter than the parts 81, 82. The part 81 with a larger inner diameter, situated on the ring 46 side (i.e. on the second shoulder 72 side), is designed to receive the annular bearing 85 (FIGS. 2 and 4) supported on the shoulder formed by means of changing the diameter between the part 81 and the inner annular part 83. The inner diameter of the bearing 85 is larger than the inner diameter of the part 83. As can be seen in FIG. 2, the shaft 43 has a cylindrical section 43.3 interposed between its cylindrical rear end 43.2 and its section with helical channels 43.1. The diameter of the section 43.3 is globally equal to that of the section 43.1, and smaller than that of the section 43.2. The axial length of the section 43.3 is globally equal to the axial length of the inner part 83 of the hub 68. The section 43.3 penetrates with mounting play in the inner part 83. It is apparent from the foregoing description that the front surface of the end 43.2 can be supported against the rear surface of the inner part 83. According to one characteristic, the front surface of the inner part 83 acts as a stop for the rear surface of the drive unit 51, when the launcher is in the withdrawn, rest position, in the knowledge that in FIG. 2 the launcher is in the advanced position of engagement with the drive ring. The withdrawn, rest position of the launcher 30 and of the drive unit can be seen in FIG. 1 of document WO 2005/054664. The front surface of the inner part 83 replaces the shoulder of the rear end of the shaft 43 in this document, the inner diameter of the cylindrical part 82 depending on the outer diameter of the cylindrical rear end of the drive unit, so that this end can penetrate in the part 82, in order for the rear surface of the drive unit 51 to abut the part 83. The inner part 83 thus makes it possible to conserve the output shaft 43.

In addition, the ring 46, which has a hollow form and is supported by the transverse wall 58, has an annular skirt 46.1 which is toothed on the interior in order to engage with the satellites 47.1. The skirt 46.1 has an orientation which is axial relative to the axis of the shaft 43, and thus has a cylindrical form. The teeth 46.4 of the skirt 46.1 have an axial orientation. The ring 46 is preferably made of a plastic material, preferably reinforced by fibres, in order to limit the noise of the gear reducer as far as possible. The skirt 46.1 is prolonged at its front end by an inner rim 46.3 with orientation which is transverse relative to the axis X and to the axis of the shaft 43. This rim 46.3 projects radially towards the interior relative to the teeth 46.4 of the skirt 46.1, and is designed to be supported by its front surface against the rear surface 58.4 of the wall 58. The transverse wall 58 is made of a metal material, and is configured to act as a friction surface via its front surface, for the friction washer 61. The ring 46—wall 58 assembly is thus made of two materials in this embodiment. The ring 46 is over-moulded on the outer periphery of the transverse wall 58. As shown in FIG. 5, with the transverse wall 58 comprising through openings 58.1, the ring 46 has pins 46.2 passing through these openings 58.1, which open onto a front surface 58.2 of the wall 58, opposite a rear surface 58.4 of the wall 58, from which the teeth of the ring 46 extend. The front end of the pins 46.2, forming heads which project relative to the front surface 58.2 of the wall 58, is compressed in contact with the front surface 58.2 of the wall 58, for securing of the ring 46, and contact of the front surface of the rim 46.3 of the latter with the rear surface 58.4 of the wall 58 which has an outer diameter larger than that of the ring 46, whilst being close to the outer diameter of the ring 46. According to this embodiment, the thickness of the friction washer 61 is greater than the thickness of the heads of the pins 46.2 implanted in an annular manner on the exterior of the outer periphery of the friction washer 61, which is thus designed to rub against the front surface 58.2 of the wall 58, and more specifically against the surface of the front face 58.2 of the wall 58 implanted in the interior of the pins 46.2 and the holes 58.1. The inner rim 46.3 is designed to form a brace between the flange of the satellite-holder 47, which in this case is secured by being crimped, or as a variant by being welded or riveted, on the rear end 43.2 of the shaft 43 and the wall 58. The ring 46 is closed at the rear by a cover 100 which is secured with centring by means of a rim with axial orientation (with no reference) on the rear end of the support 16, as can be seen in FIGS. 2 and 3. The cover 100 comprises at the rear a bush (with no reference) in this case for receipt of a needle bearing (with no reference) interposed radially between the bush of the cover 100 and a support surface of the shaft 24, as can be seen in FIG. 2. According to one embodiment, this cover is interposed by being crimped between the rear end of the support 16 and the front end of the cylinder head 15. The interior of the ring 46 can thus be filled with grease for lubrication of the satellites 47.1 and the sun gear 49. It will be appreciated that, as a variant, the cover is of the type in FIG. 1. All of this depends on the applications, and in particular on the form of the cylinder head 15.

As can be seen in FIG. 4, the transverse wall 58 is connected in rotation with the hub 68 by co-operation of forms. For this purpose, the wall 58 has a central opening 58.3, which at the front has a form complementary to that of the third section 68.3 of the hub 68 for mounting of the wall 58 on the hub 68, by axial fitting from the front to the rear. This opening 58.3 is thus delimited at the front by four flattened parts which have a form complementary to the flattened parts 79.1 of the hub 68, and are connected to one another by means of four cylindrical parts with a form complementary to the cylindrical parts 80.1 of the hub 68. At the rear, the opening 58.3 has a substantially square form with rounded angles, with a form complementary to the shoulder 72, as can be seen better in FIG. 4. More specifically, the rear surface 58.4 of the wall 58 is notched to form four notches 58.6 with rims 58.5, positioned at the four angles of the opening 58.3. In the aforementioned manner, these rims 58.5 are designed to be supported in a complementary manner against the corresponding support surfaces 77.1 of the hub 68. These support surfaces 77.1 belong to the parts 77 in the form of projections accommodated in the notches 58.6 with complimentary rims 58.5 for reduction of the axial dimensional and formation of a barrier which prevents the passage of the grease. Thus, the wall 58, in cooperation with the hub 68, prevents the grease contained in the ring 46 from contaminating the linings 61, 62.

The base plate 60, which has transverse orientation and two, respectively front and rear end surfaces 60.1, 60.2, has at least one lug 60.34 for example with a rounded form, which is designed to co-operate with a groove 88 with axial orientation of the support 16 with a complementary form (FIG. 2), such as to render the base plate 60 immobile in rotation relative to the support 16. The plate 60 can move in translation relative to the support 16 as a result of wear, particularly of the linings 61, 62. The plate 60 has a central opening 60.3 configured such that the plate 60 is not connected in rotation to the hub 68. For this purpose, the opening 60.3 has a circular form with a diameter larger than that of the cylindrical parts 80.1 of the third section 68.3. Mounting play exists between the plate 60 and the parts 80.1, in order to permit relative rotation between the plate 60, which is integral in rotation with the fixed support 16. The surface 60.1 constitutes the front surface of the plate and the surface 60.2 constitutes the rear surface of the plate 60.

The linings 61, 62 positioned on both sides of the plate 60 have a first, respectively front and rear surface 61.1, 62.1, in contact respectively with the rear surface 60.2 and the front surface 60.1 of the plate 60, and a second surface 61.2, 62.2 opposite the first surface 61.1, 62.1. The second surface 61.2 of the lining 61, which constitutes the rear surface of the latter, is in contact with the front outer surface which belongs to the front surface 58.2 of the transverse wall 58, whereas the second surface 62.2 of the lining 62, which constitutes the front surface of the latter, is in contact with the rear surface 64.2 of the washer 65 for dissipation of the forces. These linings 61, 62 are connected in rotation to the hub 68 by co-operation of forms. For this purpose, in the aforementioned manner, the linings 61, 62 each have a central opening 61.3, 62.3 with a form complementary to that of the third section 68.3. This opening 61.3, 62.3 has a substantially square form, the sides of the square being designed to be supported against the flattened parts 79.1 of the hub. These sides are connected to one another by circular edges. The friction linings 61, 62 are of the organic type, obtained for example from a bonding agent comprising heat-setting resins, fillers such as graphite, silica, talc, metal powders, and fibres such as aramid fibres, for example Kevlar®, or of the sintered type comprising metal powder, such as bronze, copper and iron sintered at a high temperature and pressure, or metal such as copper alloy (for example bronze or brass) or the like. In the embodiments in the figures, the surfaces of the linings 61, 62 are smooth, or as a variant they are grooved. The plate 60 and the wall 58 which are configured to form friction tracks for the linings 61, 62, are for example made of steel, stainless steel, bronze or cast iron, according to the nature of the linings 61, 62.

The disc 65 for dissipation of the forces is in this case is made of metal, and makes it possible to apply homogenously and over a large diameter the axial force generated by the resilient washer 64. For this purpose, the disc 65 has a front surface 65.1 which faces towards the washer 64, and a rear surface 65.2 which faces towards the front surface 62.2 of the lining 62. The disc 65 is also connected in rotation to the hub 68 by co-operation of form, and has a central opening 65.3 with a form complementary to that of the third section 68.3. Like the openings 61.3, 62.3 in the linings, this opening 65.3 has a substantially square form. The sides of the square which are designed to come into contact with the flattened parts 79.1 are connected to one another by circular edges.

The resilient washer 64 with axial action is in this case is made of metal, and has a front surface 64.1 which faces towards the closure washer 67, for support at its inner periphery on this washer 67, and a rear surface 64.2 which faces towards the dissipation disc 65, for support on its outer periphery on the front surface 64.1 of this disc. The resilient washer 64 is for example a washer of the Belleville type, which as a variant has a collar or shelving on its outer periphery for support on the front surface 64.1 of this disc 65. Thus, the length L, which can be seen in FIG. 5, depends on the length L' of the wear of the linings 61, 62, and on the characteristic curve of the Belleville washer, which, as is known, has a globally sinusoidal form. This washer 64 is made to work in the vicinity of the top of its characteristic curve, such that the load developed by this washer is globally constant despite the wear of the washers 61, 62. As a variant, this resilient washer is a diaphragm, i.e. a Belleville washer which is prolonged on its inner periphery by tabs. As a variant, this resilient washer is an undulating washer. All these resilient washers mounted on the hub 68 have a small axial dimensional, and are configured to exert a load, i.e. a pressure, on the disc 65, which can vary according to the wear of the linings 61, 62. As a variant, it is possible to use washers which are superimposed or mounted in the inverse direction in order to obtain the load required in a reduced radial dimensional. The type of resilient washer 64 and the number of them (more than one washer can be used) thus makes it possible to obtain the required pressure, and consequently the limit resistance torque of the torque limiter. This type of washer acts via its outer periphery in the vicinity of the outer periphery of the disc 65, with a larger outer diameter, which in this case is close to the outer diameter of the linings 61, 62. Better distribution of the loads on the washers 61, 62 is obtained than in the structure according to document FR 2 631 094. As a variant, the washer(s) 64 is/are replaced by a helical spring with a frusto-conical form, the smallest diameter of which is supported on the closure washer 67. As a variant, according to a downgraded embodiment, a cylindrical helical spring with a large diameter is used, in order to be able to exert action on a large diameter of the disc 65. The solutions which use helical springs are larger axially. The resilient means with axial action thus comprise at least one resilient washer with axial action, or a helical spring.

The closure washer 67 is in this case is made of metal, and enters into co-operation with the groove 74 provided around the first section 68.1. The washer 67 has a rear surface 67.1 which faces towards the resilient washer 64, and a front surface 67.2 which faces towards the front axial end 69 of the hub 68 and towards the shoulder 71 for contact with the latter. In one example, the closure washer 67 is in the form of a washer provided with ribs 67.5 which face towards the shoulder 71 and holes 67.6. The central opening 67.3 in the washer 67 comprises four flattened parts 67.9 which are connected in pairs by circular edges 67.8. The shoulder 71 has a form complementary to that of the opening 67.3 in the washer 67, and has four flattened parts 71.7 which are connected in pairs by circular parts 71.8. The shoulder 71 is in the image of the third section 68.3 transversely with a larger size, such that the flattened parts 71.7 are in the extension of the flattened parts 79.1, and the circular parts 71.8 are in the extension of the circular parts 80.1. It will be noted that each circular part 71.8 is notched centrally at 71.9 for accommodation of the inner periphery of a rib 67.5. This notch 71.9 also affects the rear flank of the groove 74, as can be seen in FIG. 6. Thus, mounting means of the bayonet type intervene between the closure washer 67 and the shoulder 71 for mounting of the bayonet type of the washer 67 in its groove 74, and with blocking in rotation of the washer 67 in the manner described below. As a variant, the washer 67 can be in the form of a split resilient ring of the Circlips® type, which can be installed in the interior of the groove 74 by resilient deformation. In this case, the shoulder 71 is continuous. As a variant, the shoulder 71 comprises only two flattened parts 71.7, which are separated by two circular parts 71.8, and the washer 67 comprises two flattened parts 67.9 and two circular edges 67.8.

The functioning is as follows, in normal operation, the resilient washer 64 is supported indirectly on the shoulder 71 via the washer 67 and on the disc 65, in order to compress the elements 58, 60, 61, 62 axially between the disc 65 which forms a pressure disc and the support surfaces 77.1 of the shoulder 72 which forms a reaction shoulder. The elements 58, 60, 61, 62, 65 act as if they form only a single part which is immobile in rotation relative to the support 16 via the plate 60.

On the other hand, if forces greater than normal arise, for example if the resistant torque applied is greater than the torque of the electric motor of the starter, the wall 58 and the disc 65 slide and are displaced in rotation relative to the base plate 60, which is fixed in rotation by means of the friction linings 61, 62, thus making it possible to limit the torque applied to the starter. This therefore avoids giving rise to overheating of the electric motor 11, or to deterioration of the mechanical elements of the starter.

In order to make the mounting of the assembly 57 easy to handle and transport, via the front axial end 69 of the hub 68, the transverse wall 58 of the ring 46 is introduced axially onto the third section 68.3, such that the rims 58.5 which it has on its inner periphery come into contact with the support surfaces 77.1 of the hub 68. The first friction lining 61 is then fitted via its opening 61.3 onto the third section 68.3, such that its rear dorsal surface 61.2 is in contact with the front outer surface 58.2 of the wall 58. The base plate 60 is then introduced via its opening 60.3 onto the third section 68.3, such that its rear surface 60.2 is in contact with the front frontal surface 61.1 of the lining 61. The second friction lining 62 is then introduced via its opening 62.3 onto the third section 68.3, such that its rear dorsal surface 62.1 comes into contact with the other front surface 60.1 of the base plate 60.

The disc 65 for dissipation of the forces is then positioned via its opening 65.3 on the third section 68.3, against the dorsal surface 62.2 of the lining 62. The resilient washer 64 is then fitted on the second section 68.2, then the closure washer 67 is mounted, by carrying out the bayonet mounting of the washer 67 on the shoulder 71. More specifically, the flattened parts 67.5 of the washer 67 are brought facing the flattened parts 71.7 of the shoulder 71. An axial force F (FIG. 6) is then applied on the closure washer 67, according to a direction going from the front end 69 towards the rear end 70, by means of a dedicated tool (not shown), in order to compress the washer 64 and deform the latter in contact with the disc 65, which is fixed in rotation relative to the hub 68, in order to pass through the shoulder 71, the gap between two diametrically opposite flattened parts 67.9 of the washer 67 being, to within the mounting play, equal to the outer diameter of the base of the groove 74. The washer 67 is then turned by means of the tool comprising three lugs, each engaged in a hole 67.6 in the washer 67, in order to bring the flattened parts 67.9 of the central opening in the washer 67 facing parts 71.8 of the shoulder 71. Finally, the pressure on the washer 67 is released such that, firstly, each rib 67.5 is accommodated in a notch 71.9, in order to block the washer 67 in rotation relative to the hub 68, and secondly, the base plate 60 is maintained under pressure between the friction linings 61, 62. The bearing 85 is then positioned inside the opening 81 in the interior of the hub 68, and the shaft 43 of the launcher equipped with the satellite-holder 47 and a bracing washer 93 is introduced by passing it via the rear end 70 according to the arrow with the reference 91 in FIG. 2, such that the rear end 43.2 of the shaft 43 comes into contact with the inner annular shoulder 83 of the hub 68. It will be noted that the bracing washer 93 is interposed axially between the satellite-holder 47 and the rear surface of the wall 58. This washer 93 is thicker than the inner rim 46.3 of the ring 46 and is accommodated in the interior of the rim 46.3. The lug 60.34 is then positioned in a cavity 88 with axial orientation in the support 16, for blocking in rotation of the plate 60. This mounting is possible because radial play exists between the plate and the hub 68 in the aforementioned manner. Then, the launcher 30 is mounted on the shaft 43 from the front to the rear, then the stop 43 is mounted, and finally, the shaft 43 thus equipped is fitted in the bearing 42. As the final operation, in a known manner, the front end of the shaft 24 is fitted in the blind hole and in the smooth bearing of the rear end 43.2 of the shaft 43, with interposition of a ball.

Figure 9:
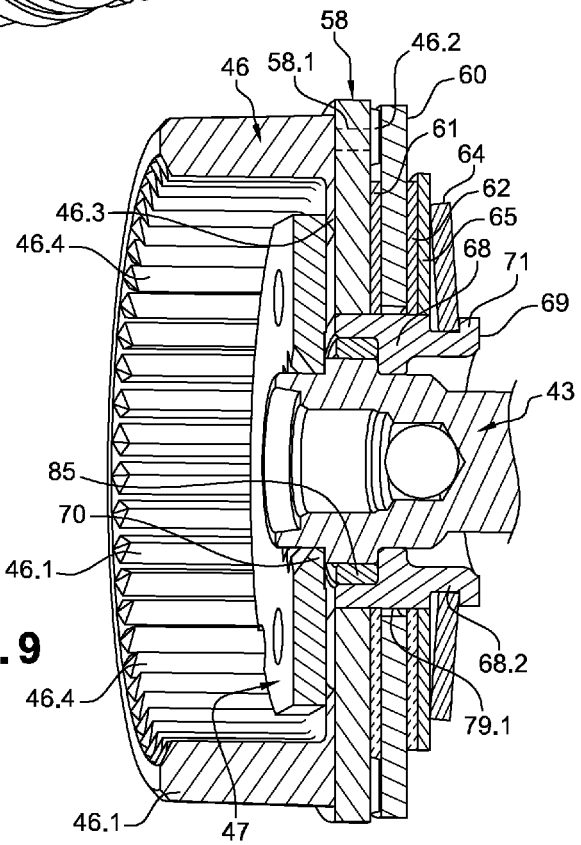
FIG. 9 is a view in cross-section of a variant embodiment of a reducer assembly according to the invention.

As a variant, as represented in FIG. 9, the washer 67 is eliminated, and the resilient washer 64 is supported directly on the first shoulder 71 of the hub 68 constituted by turning back material of the hub 68 at the level of the front end 69. More specifically, the second section 68.2 of the hub is prolonged as far as the front end 69 of the hub, and the free end of this second section 68.2 is deformed radially towards the exterior by crimping, in order to form the first shoulder 71 against which the inner periphery of the washer 64 is supported directly. According to one embodiment, the free end of the second section, which constitutes the front end 69, is continuous. As a variant, this free end is divided up into tabs, in order to facilitate the crimping operation. In this case, the hub 68 has been cut at the level of a flattened part 79.1, which ends at the level of the rear surface 70 of the hub 68, such that the shoulder 72 in FIGS. 2 to 8 is retained. As a variant, in the aforementioned manner, this shoulder 72 is continuous, and the wall 58 has a constant thickness, and is supported via its rear surface on the front surface of the shoulder 72. As a variant, the shoulder 72 is added by welding or riveting onto the rear end 70 of the hub 68. In FIG. 9, 93 shows the bracing washer interposed between the satellite-holder 47 and the rear surface of the wall 58. This washer 93 is accommodated in the interior of the central opening in the rim 46.3. It will be appreciated that, as a variant, the shoulder 71 is added by welding, riveting or screwing onto the front end 69. All the combinations are possible. The shoulders 71, 72 are in all cases supported by the hub 68.

As a variant, at least one of the two friction linings 61, 62 is eliminated. For example the lining 61 is eliminated, the base plate 60 then being directly in contact with the pins 46.2 of the ring 46. As a variant, the lining 62 is also eliminated, with the plate 60 rubbing against the disc 65. As a variant, a single friction lining 61, 62 is retained. As a variant, the disc 65 is eliminated, with the washer 64 rubbing directly on the plate 60.

As a variant, for connection in rotation of the hub 68, the linings 61, 62, the transverse wall 58 and the disc 65 for dissipation of the forces, the latter 58, 61, 62, 65 comprise channels in their inner periphery which enter into co-operation with complimentary channels provided in the outer periphery of the third section 68.3 of the hub 68. As a variant, the flattened parts are thus replaced by channels.

As a variant, the linings 61, 62 are glued on both sides of the base plate 60 by means of their surface 61.1, 62.1.

The terms "front" and "rear" are understood relative to the direction of transfer of the torque of the machine to the drive pinion, with the "front" side thus being on the drive pinion 50 side, whereas the "rear" side is on the electric motor side of the electrical machine.

It will be appreciated that the assembly 57 for a speed reducer according to the invention is also designed for use with a speed reducer without satellite-holders, and comprising only a ring 46 and an offset wheel which engages directly with the inner toothing of the ring 46, as described in document FR-2 631 094.

The starter 10 according to the invention is particularly well suited for vehicles of the "start stop" type, comprising a thermal engine which is stopped for example at a red light, or in traffic jams, and is restarted by means of the starter according to the invention.

It will be appreciated that, as a variant, the thermal engine is fixed, and is used for example to drive a power take-off.

In general, the number of flattened parts 79.1 depends on the torque to be transmitted, and the solution according to the invention does not modify the starter profoundly. It is apparent from the description and the figures that the modification of the shaft 43 is simple and economical. It consists of a change of diameter between the cylindrical section 43.3 and the cylindrical rear end 43.2. In addition, the blocking in rotation of the plate 60 is carried out simply by means of at least one cavity 88 with axial orientation. The number of cavities 88 and lugs 60.34 depends on the applications. The toothed ring 46 is simplified, since it is not configured to co-operate with the outer periphery of the bearing, and is not configured to act as a support for a resilient washer with axial action. In addition, the forces are absorbed by the hub 68 and the wall 58, such that the ring 46 is conserved. As a variant, the wall 58 is in a single piece with the ring 46. The invention can be applied in the aforementioned manner to solutions wherein the lever 41 is mounted in an articulated manner, differently from the ring 46. The electric motor 11 of the starter is unchanged, such that, as a variant, the collector is flat. As a variant, the pinion 50 of the launcher 30 is mounted in the aforementioned manner on the exterior of the housing. According to one embodiment, this pinion engages with a toothed wheel which is designed to be engaged with the drive ring.

It is possible to invert the structures such that, as a variant, the blocking in rotation of the plate 60 is carried out by means of at least one axial projection of the support 16, such as a rib with a semi-circular cross-section, engaged in a complementary opening provided in the outer periphery of the plate 60. As a variant, the support 16 bears at least one pin which is engaged in a sliding manner in a complementary opening in the plate 90.

The invention claimed is:

1. An assembly (57) for a speed reducer of a rotary electrical machine (11), comprising:

a toothed ring (46) integral with a transverse wall (58);

a base plate (60) mounted integrally non-rotatably to a support (16) of the machine;

a resilient member with axial action (64); and an added-on hub (68) supporting the transverse wall (58) of the toothed ring (46), the base plate (60) and the resilient member (64);

the added-on hub (68) including at least one first shoulder (71) for support of the resilient member (64) with axial action and at least one second shoulder (72) for support of the transverse wall (58) of the toothed ring (46);

the base plate (60) axially moveable relative to the transverse wall (58) and rotatably mounted to the added-on hub (68) between the transverse wall (58) and the resilient member (64);

the transverse wall (58) non-rotatably mounted to the added-on hub (68).

2. The assembly according to claim 1, wherein the resilient means with axial action (64) are supported indirectly on the first shoulder (71) by means of a closure washer (67) which is supported on the first shoulder (71), and is positioned in a groove (74) provided around the hub (68).

3. The assembly according to claim 2, further comprising mounting means of the bayonet type, which can ensure cooperation between the first shoulder (71) and the closure washer (67).

4. The assembly according to claim 1, wherein the first shoulder (71) is constituted by turning down material of the hub (68).

5. The assembly according to claim 1, wherein the toothed ring (46) is made of a plastic material, and wherein the toothed ring (46) is over-molded on an outer periphery of the transverse wall (58).

6. The assembly according to claim 5, wherein, with the transverse wall (58) comprising through openings (58.1), the ring (46) comprises pins (46.2) which pass through these openings (58.1), the pins (46.2) opening onto an outer surface (58.2) of the transverse wall (58), opposite an inner surface (58.4) from which the teeth of the ring (46) extend.

7. The assembly according to claim 6, wherein the base plate (60) is supported directly on the pins (46.2) of the ring (46).

8. The assembly according to claim 7, further comprising a friction lining (61) which is interposed between the transverse wall (58) of the ring and the base plate (60).

9. The assembly according to claim 8, further comprising a friction lining (62) which is positioned between the base plate (60) and the resilient washer (64) with axial action.

10. The assembly according to claim 9, wherein the friction lining is non-rotatably connected to the added-on hub (68).

11. The assembly according to claim 10, wherein the hub (68) has at least one flattened part (79.1), and in that the friction lining has/have an opening (61.3, 62.3) with at least one flattened part (79.1) with a complementary form, for connection in rotation with the added-on hub (68) by co-operation of forms.

12. The assembly according to claim 11, wherein the hub (68) comprises a section (68.3) with four flattened parts (79.1) which are parallel in pairs, connected to one another by means of cylindrical parts (80.1), the friction lining having an opening (61.3, 62.3) with a complementary form.

13. The assembly according to claim 12, wherein the lining is glued on a lateral surface of the base plate (60).

14. The assembly according to claim 12, wherein the second shoulder (72) is divided up into several parts (77) belonging to the hub (68), and each having support surfaces (77.1).

15. The assembly according to claim 14, wherein the support surfaces (77.1) of the parts (77) are offset angularly relative to the flattened parts (79.1).

16. The assembly according to claim 14, wherein the cylindrical parts (80.1) are each connected to a part (77) belonging to the hub.

17. The assembly according to claim 16, wherein the transverse wall (58) has a central opening (58.3), and is hollowed at the level of its central opening (58.3) for formation of four rims (58.5) for receipt of the parts (77).

18. The assembly according to claim 17, further comprising a washer (65) for dissipation of the forces associated with the resilient means (64) with axial action.

19. The assembly according to claim 18, wherein the resilient means with axial action consist of a resilient washer (64) with axial action comprising a washer of the Belleville type.

20. A starter (10) for a motor vehicle, comprising:

an electrical machine (11) comprising an output shaft (24);

an epicycloidal train comprising a planet wheel (49) which is connected in rotation to the output shaft (24) of the electrical (11) machine;

a speed reducer assembly (57) comprising:

a toothed ring (46) integral with a transverse wall (58);

a base plate (60) mounted integrally non-rotatably to a support (16) of the machine;

a resilient member with axial action; and an added-on hub (68) supporting the transverse wall (58) of the toothed ring (46), the base plate (60) and the resilient member (64);

the added-on hub (68) including at least one first shoulder (71) for support of the resilient member (64) with axial action and at least one second shoulder (72) for support of the transverse wall (58) of the toothed ring (46); and a satellite-holder (47) engaging firstly with the planet wheel (49), and secondly with the toothed ring (46) of the speed reducer assembly, the satellite-holder (47) being non-rotatably connected with an output shaft (43) of the starter which supports a drive pinion (50) designed to be engaged with the teeth of the drive ring of a thermal engine of the vehicle;

the base plate (60) axially moveable relative to the transverse wall (58) and rotatably mounted to the added-on hub (68) between the transverse wall (58) and the resilient member (64);

the transverse wall (58) non-rotatably mounted to the added-on hub (68).

21. The starter according to claim 20, wherein the hub (68) has in a center thereof a transverse opening (68.4) which permits the passage of the output shaft (43) of the starter, wherein the pinion (50) belongs to a launcher (30) comprising a drive unit (51), wherein the transverse opening (68.4) comprises two cylindrical parts (81, 82) which are separated by an inner annular part (83) with a smaller inner diameter than the two other cylindrical parts (81, 82), and wherein the inner annular part (83) constitutes a stop which is designed to co-operate with the rear surface of the drive unit (51).

* * * * *